US007213827B2

(12) United States Patent
Yeh

(10) Patent No.: US 7,213,827 B2
(45) Date of Patent: May 8, 2007

(54) SLIDER WITH BRAKE PLATE

(76) Inventor: Tzong In Yeh, 4566 Crestwood St., Fremont, CA (US) 94538

( * ) Notice: Subject to any disclaimer, the term of this patent is extended or adjusted under 35 U.S.C. 154(b) by 0 days.

(21) Appl. No.: 11/437,790

(22) Filed: May 22, 2006

(65) Prior Publication Data

US 2006/0232044 A1 Oct. 19, 2006

Related U.S. Application Data

(63) Continuation-in-part of application No. 11/108,451, filed on Apr. 18, 2005, now Pat. No. 7,059,623.

(51) Int. Cl.
*A63C 7/10* (2006.01)

(52) U.S. Cl. ..... 280/605; 280/604; 280/809; 280/28.11

(58) Field of Classification Search ..... 280/605, 280/604, 28.11, 809, 816; 188/8, 128
See application file for complete search history.

(56) References Cited

U.S. PATENT DOCUMENTS 2,302,478 A * 11/1942 Snow ..... 280/605
2,781,200 A * 2/1957 Robison ..... 280/826
4,152,007 A * 5/1979 Smith ..... 280/605
4,234,207 A * 11/1980 De Vigili ..... 280/605
4,256,319 A * 3/1981 Winter ..... 280/18
4,288,092 A * 9/1981 Mukri ..... 280/605
4,690,423 A * 9/1987 DeVigili ..... 280/605
5,509,683 A * 4/1996 Daniel ..... 280/605
5,553,403 A * 9/1996 McManus ..... 36/124
5,673,772 A * 10/1997 Martin ..... 188/6
6,637,552 B1 * 10/2003 Peterson ..... 188/8
7,059,623 B1 * 6/2006 Yeh ..... 280/605

* cited by examiner

*Primary Examiner*—J. Allen Shriver
(74) *Attorney, Agent, or Firm*—Rosenberg, Klein & Lee

(57) ABSTRACT

A slider comprises a main board and a brake plate. The main board has a bottom face facing to and movable on a snow ground, and has a rear end raised to an angle relative to the snow ground. The brake plate has a connecting portion connected with the bottom face of the main board at the rear end of the main board, and a shovel portion protruding from the connecting portion for shoveling into the snow ground. Additionally, the shovel portion has plural drain holes formed thereon for draining the snow shoveled by the shovel portion.

10 Claims, 4 Drawing Sheets

SLIDER WITH BRAKE PLATE

CROSS REFERENCE TO RELATED APPLICATION

This is a continuation-in-part application of the U.S. Ser. No. 11/108,451 application, filed on Apr. 18, 2005 now U.S. Pat. No. 7,059,623.

TECHNICAL FIELD

The present invention relates to a slider, and more particularly to a slider with a brake plate.

BACKGROUND OF THE INVENTION

A conventional slider has a braking effect that is achieved by a sharp turning action of the slider. Thus, the braking effect is limited by a variety of fields and skills of a rider.

Various techniques for the braking effect to a slider are employed. One conventional technique is found in U.S. Pat. No. 5,509,683, which discloses a ski brake assembly including a snow-engaging braking blade. The braking blade is driven by an electric motor through a blade drive assembly. Another conventional technique can be found in U.S. Pat. No. 4,152,007, which discloses a ski brake comprising plow means.

A further conventional brake device for a slider is disclosed in Taiwanese Patent Publication No. 530682. The brake device mainly comprises a pedal with a flat plate mounted on the slider. The flat plate is relative to the snow ground and provided for contacting with the snow ground so as to generate the braking effect. However, when the pedal is stamped on to cause the flat plate to contact with the snow ground, the flat plate is easily slipping on the snow ground. Accordingly, the braking effect is limited.

Therefore, it would be advantage of providing a simplified braking system to a slider without a need of extra power system. Additionally, it would also be advantage of providing a braking system to a slider that is easy to assemble and effective in brake.

From the foregoing descriptions, it will be seen that room exists for improvements in the slider with a brake device.

SUMMARY OF INVENTION

It is therefore an object of this invention to provide a slider with a brake plate so that a rider of the slider can control the brake plate to stop the slider easily and conveniently.

Another object of the invention is to provide the brake plate, which is simple in structure and is easy to be assembled to a slider, such as a snowboard or a snow sled. At the same time, the brake plate is easy to operate and effective in brake.

A further objective of the present invention is to provide a slider with a brake plate, which has a shovel portion with plural drain holes. When the shovel portion of the brake plate is shoveled into a snow ground, the snow shoveled by the shovel portion is drained outward from the drain holes so as to provide with special visual effects to viewers.

More particularly, the slider of the present invention comprises a main board and a brake plate. The main board has a bottom face facing to and movable on a snow ground, and has a rear end raised to an angle relative to the snow ground. The brake plate has a connecting portion connected with the bottom face of the main board at the rear end of the main board, and a shovel portion protruding from the connecting portion for shoveling into the snow ground. Additionally, the shovel portion has plural drain holes formed thereon for draining the snow shoveled by the shovel portion.

Further benefits and advantages of the present invention will become apparent after a careful reading of the detailed description with appropriate reference to the accompanying drawings.

DETAILED DESCRIPTION OF PREFERRED EMBODIMENTS

Figure 1:
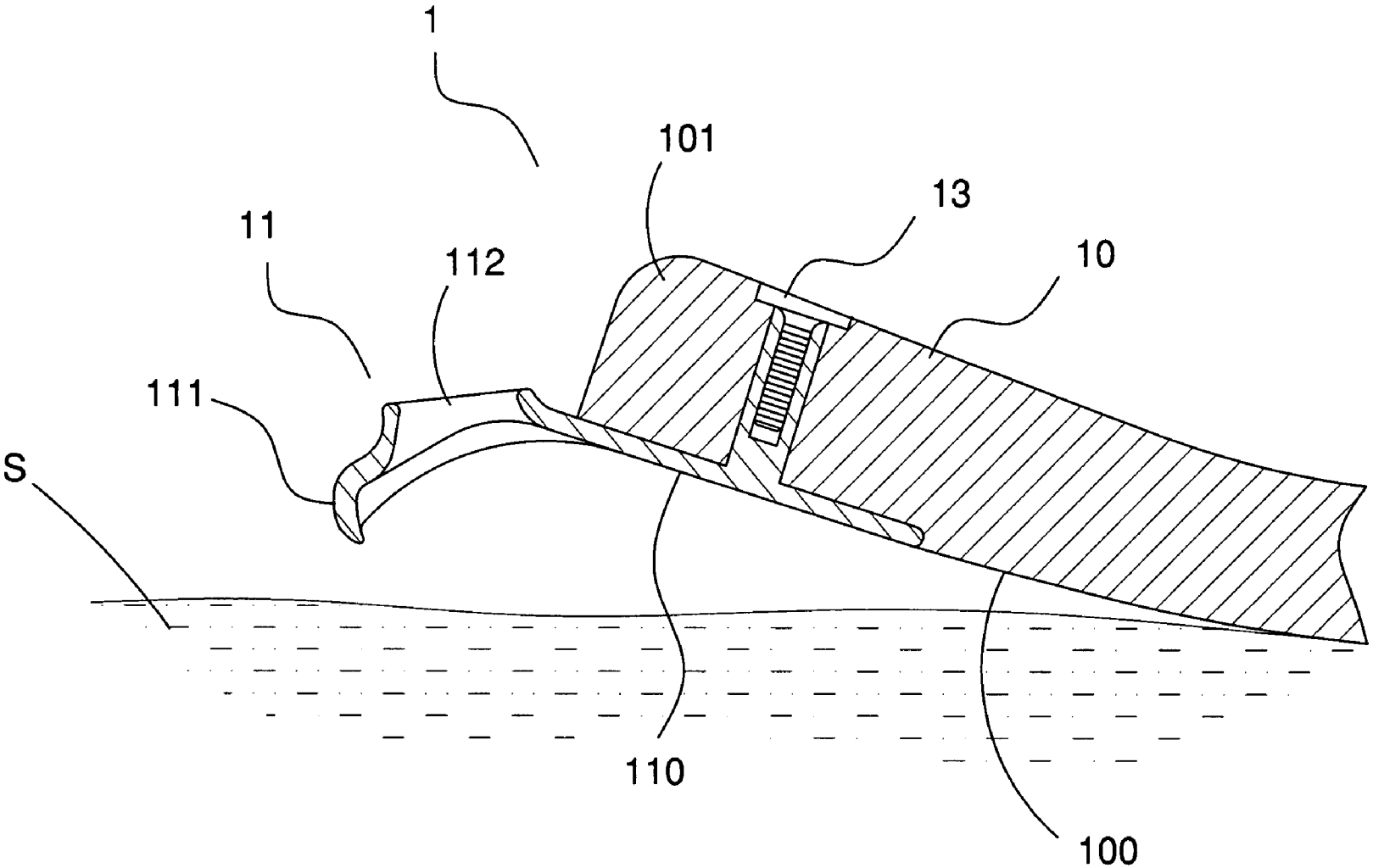
FIG. 1 is a cross-sectional view of the present invention.

FIGS. 1 to 4 show a slider 1 as a preferred embodiment of the present invention. In FIG. 1, the slider 1 comprises a main board 10 and a brake plate 11. The main board 1 has a bottom face 100 facing to and movable on a snow ground "S", and has a rear end 101 raised to an angle relative to the snow ground "S". Additionally, the brake plate 11 is fixed to the main board 10, and has a connecting portion 110 and a shovel portion 111. The connecting portion 110 is connected with the bottom face 100 of the main board 10, at the rear end 101 of the main board 10. The shovel portion 111 protrudes from the connecting portion 110 and has plural drain holes 112 formed thereon. The shovel portion 111 is provided for shoveling into the snow ground "S". Furthermore, the drain holes 112 are provided for draining the snow shoveled by the shovel portion 111.

In the present invention, the main board 10 is preferably made of expanded foam-based board or any suitable board used to slide over a snow covered surface. The brake plate 11 is preferably made of resilient and flexible material, such as PE materials.

Figure 4:
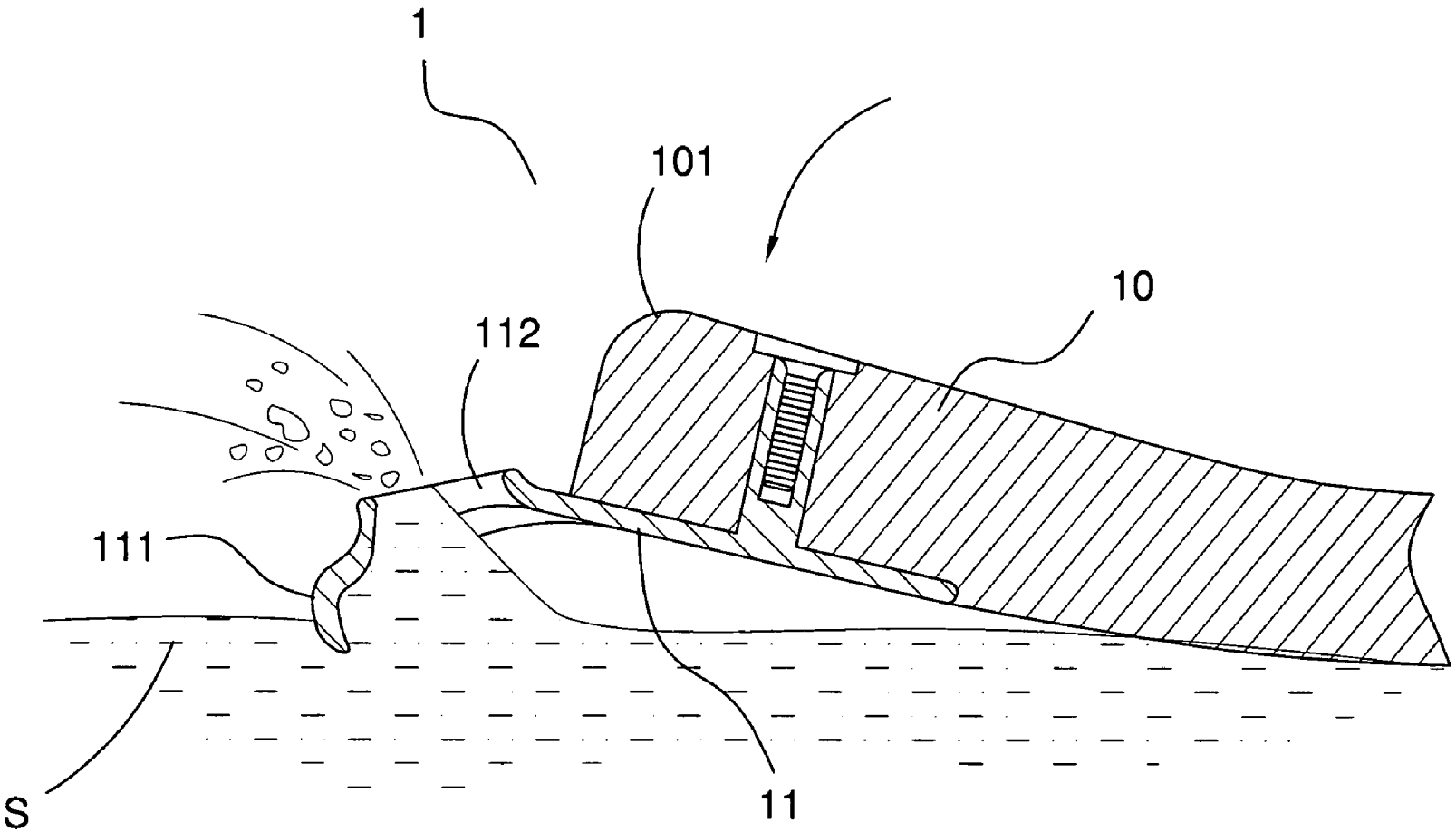
FIG. 4 is a cross-sectional view of the present invention, showing the brake plate in use.

In practice, when a rider is seated on the main board 10 and is sliding on the snow ground "S", the rider can simply use his/her hand to press the rear end 101 of the main board 10 so as to have the brake plate 11 inserted into the snow ground "S" for the purposes of stopping the sliding movement of the slider, as shown in FIG. 4. Alternatively, the rider also can lean back his/her body to have the brake plate 11 inserted into the snow ground "S" so as to stop the slider.

Figure 2:
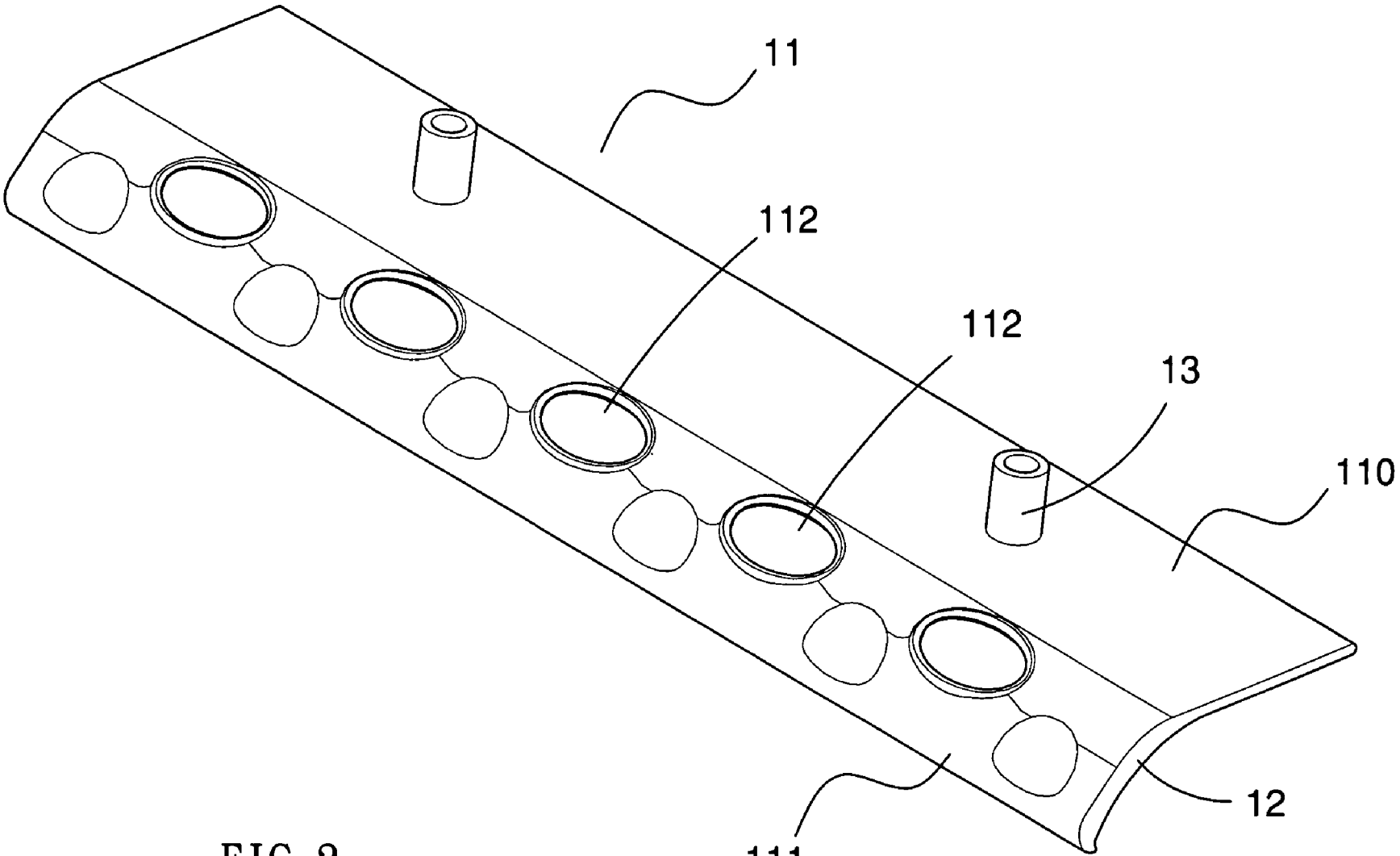
FIG. 2 is a top perspective view of a brake plate of the present invention.
Figure 3:
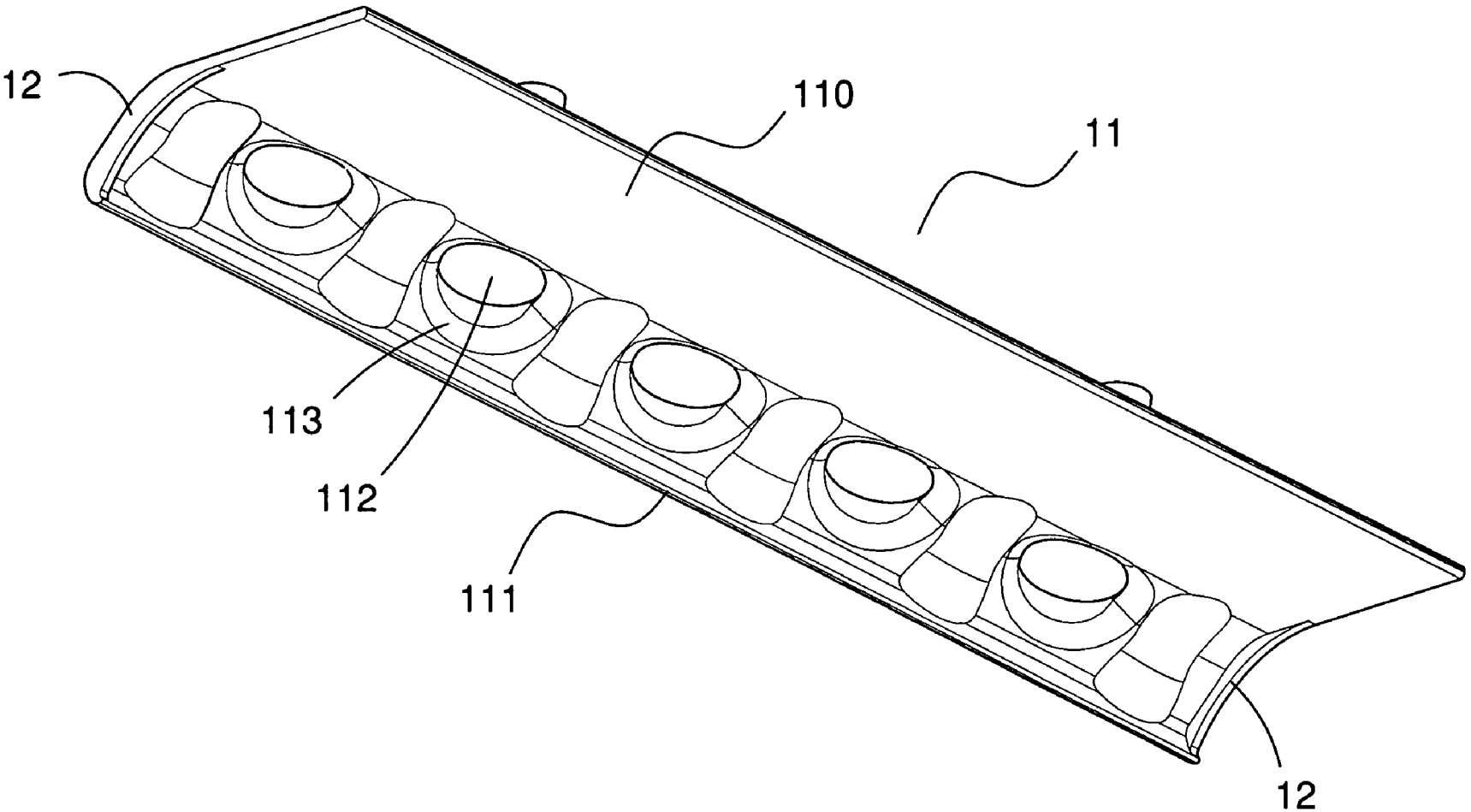
FIG. 3 is a bottom perspective view of the brake plate of the present invention.

Furthermore, as shown in FIGS. 2–3, the brake plate 11 further has plural reinforced members 12 for connecting between the connecting portion 110 and the shovel portion 110 so as to prevent the shovel portion 110 from snapping under operations of the brake plate 11.

In FIGS. 1 and 2, the brake plate 11 of the present invention further has plural assembly units 13 formed on the connecting portion 110 for fixing into the main board 10. Additionally, the main board 10 has through holes formed thereon, and the assembly units 13 are positioned in the through holes so as to fix the connecting portion 110. In the present invention, the assembly units 13 can be any suitable connecting members as known in the present art, such as snap rivets, bolts and the like. Additionally, the shovel portion 111 of the brake plate 11 is preferably formed in an arch shape so as to provide a better braking effect.

As shown in FIG. 3, the shovel portion 111 of the brake plate 11 has a bottom face formed with plural guiding curves 113 connected with the drain holes 112 respectively for guiding the snow shoveled by the shovel portion 111 into the drain holes 112.

FIG. 4 further shows that the brake plate 11 is in use. When the brake plate 11 is pressed toward the snow ground "S" by the rider, the shovel portion 111 is inserted into the snow ground "S" to shovel the snow accordingly, so as to generate a resistance to stop the slider 1 gradually. Meanwhile, the snow shoveled by the shovel portion 111 is guided by the guiding curves 113 and is drained out via the drain holes 112, which can not only provide for preventing the shoveled snow from being gathered in the shovel portion, but also generate a spray effect to attract viewers.

Numerous characteristics and advantages of the invention have been set forth in the foregoing description, together with details of the structure and function of the invention, and the novel features thereof are pointed out in appended claims. The disclosure, however, is illustrative only, and changes may be made in detail, especially, in matters of shape, size and arrangement of parts, materials and the combination thereof within the principle of the invention, to the full extent indicated by the broad general meaning of the terms in which the appended claims are expressed.

I claim:

1. A slider comprising:

a main board, having a bottom face facing to and movable on a snow ground, and having a rear end raised to an angle relative to the snow ground; and a brake plate comprising:

a connecting portion connected with the bottom face of the main board at the rear end of the main board;

a shovel portion protruding from the connecting portion for shoveling into the snow ground, wherein the shovel portion has plural drain holes for draining the snow shoveled by the shovel portion; and plural reinforced members provided for connecting the connecting portion to the shovel portion.

2. The slider of claim 1, wherein the brake plate further has plural assembly units formed on the connecting portion for fixing into the main board.

3. The slider of claim 1, wherein the shovel portion of the brake plate is formed in an arch shape.

4. The slider of claim 1, wherein the shovel portion of the brake plate has a bottom face formed with plural guiding curves connected with the drain holes respectively for guiding the snow shoveled by the shovel portion into the drain holes.

5. The slider of claim 4, wherein the shovel portion of the brake plate is formed in an arch shape.

6. A brake plate for connecting with a main board, having:

a connecting portion provided for connecting with a bottom face of the main board at a rear end of the main board;

a shovel portion protruding from the connecting portion for shoveling into a snow ground, wherein the shovel portion has plural drain holes for draining the snow shoveled by the shovel; and plural reinforced members provided for connecting the connecting portion to the shovel portion.

7. The brake plate of claim 6, further having plural assembly units formed on the connecting portion for fixing into the main board.

8. The brake plate of claim 6, wherein the shovel portion is formed in an arch shape.

9. The brake plate of claim 6, wherein the shovel portion has a bottom face formed with plural guiding curves connected with the drain holes respectively for guiding the snow shoveled by the shovel portion into the drain holes.

10. The brake plate of claim 9, wherein the shovel portion is formed in an arch shape.

* * * * *